US005836125A

United States Patent [19]

Regina

[11] Patent Number: 5,836,125

[45] Date of Patent: Nov. 17, 1998

[54] INTERLOCKING TRANSLUCENT BLOCKS

[76] Inventor: Samuel R. Regina, 5450 E. Capri, Mesa, Ariz. 85206

[21] Appl. No.: 687,978

[22] Filed: Jul. 29, 1996

[51] Int. Cl.[6] ..... E04C 1/00; E04B 2/00

[52] U.S. Cl. ..... 52/306; 52/580; 52/590.2; 52/591.1; 52/592.1; 52/592.6; 52/775

[58] Field of Search ..... 52/306, 308, 591.1, 52/591.3, 592.1, 592.6, 762–764, 775, 781, 307, 580, 590.2, 591.2, 592.2, 592.3

[56] References Cited

U.S. PATENT DOCUMENTS

| | | | |
|---|---|---|---|
| 4,628,652 | 12/1986 | Wefels | 52/306 |
| 5,014,479 | 5/1991 | Yeh et al. | 52/308 |
| 5,033,245 | 7/1991 | Kline | 52/308 X |
| 5,121,575 | 6/1992 | DeGarmo et al. | 52/591 X |
| 5,247,773 | 9/1993 | Weir | 52/592.3 |
| 5,367,846 | 11/1994 | VonRoenn | 52/308 |

FOREIGN PATENT DOCUMENTS

| | | | |
|---|---|---|---|
| 1401279 | 4/1965 | France | 52/306 |

*Primary Examiner*—Robert Canfield
*Attorney, Agent, or Firm*—Cahill, Sutton & Thomas

[57] ABSTRACT

An interlocking building block includes a block fastening system having a male coupling element and a female receptacle which cooperate together to secure a first block to a second block. The male coupling element includes a male interlocking element and a pedestal element for supporting the interlocking element at a fixed distance from the block sidewall. The female receptacle includes first and second female interlocking elements and spaced apart first and second female pedestal elements which support each female interlocking element.

19 Claims, 5 Drawing Sheets

INTERLOCKING TRANSLUCENT BLOCKS

BACKGROUND OF THE INVENTION

1. Field of the Invention

This invention relates generally to building materials and more particularly to translucent blocks used in construction.

2. Description of the Prior Art

A variety of translucent blocks are used in the construction field and are fabricated from materials such as glass, acrylic or plastic. Such blocks are frequently assembled into a structural grouping by applying mortar between the blocks, a process which requires substantial assembly labor.

A variety of techniques have been developed to assemble translucent block structures, including the techniques disclosed in U.S. Pat. No. 4,891,925, entitled "Interconnected Construction Block" issued to Carlson, et al. on Jan. 9, 1990. Carlson's approach relies on blocks having edge-mounted receptacles and keys insertable between adjacent blocks. While Carlson's technique performs the desired function, it requires an additional key component and careful block alignment, but fails to materially simplify the assembly of a collection of discrete blocks into a wall system.

SUMMARY OF THE INVENTION

The present invention provides blocks having attachment mechanisms to interlock one block with adjacent blocks. A set of tabs located along an edge of the block outer surface assists in aligning a set of blocks into a structural unit. By providing a system of interlocks and alignment tabs, blocks can be readily assembled and aligned in three dimensions.

The translucent characteristic of the blocks facilitates their use as windows, skylights and room dividers. In one preferred embodiment of the invention fabricated from light weight acrylic plastic, the overall weight of the system is substantially reduced in comparison to conventional glass block systems.

In one embodiment, plastic blocks are secured to each other into a shape defined by a perimeter frame. Security is provided by a cable or by a network of cables which extend between the blocks and are secured to the frame itself. In this embodiment, the small grout channel located between the blocks is preferably filled with a silicone adhesive which conceals the cables, weather proofs the assembly and provides a visually pleasing product. The cables also prevent a burglar from knocking out the blocks to gain access to the interior of a building.

The hollow interior of the blocks creates a dead air space substantially enhancing the insulating properties of the block system.

Various specific embodiments of the invention are described in the following written description.

DESCRIPTION OF THE PREFERRED EMBODIMENT

Figure 1:
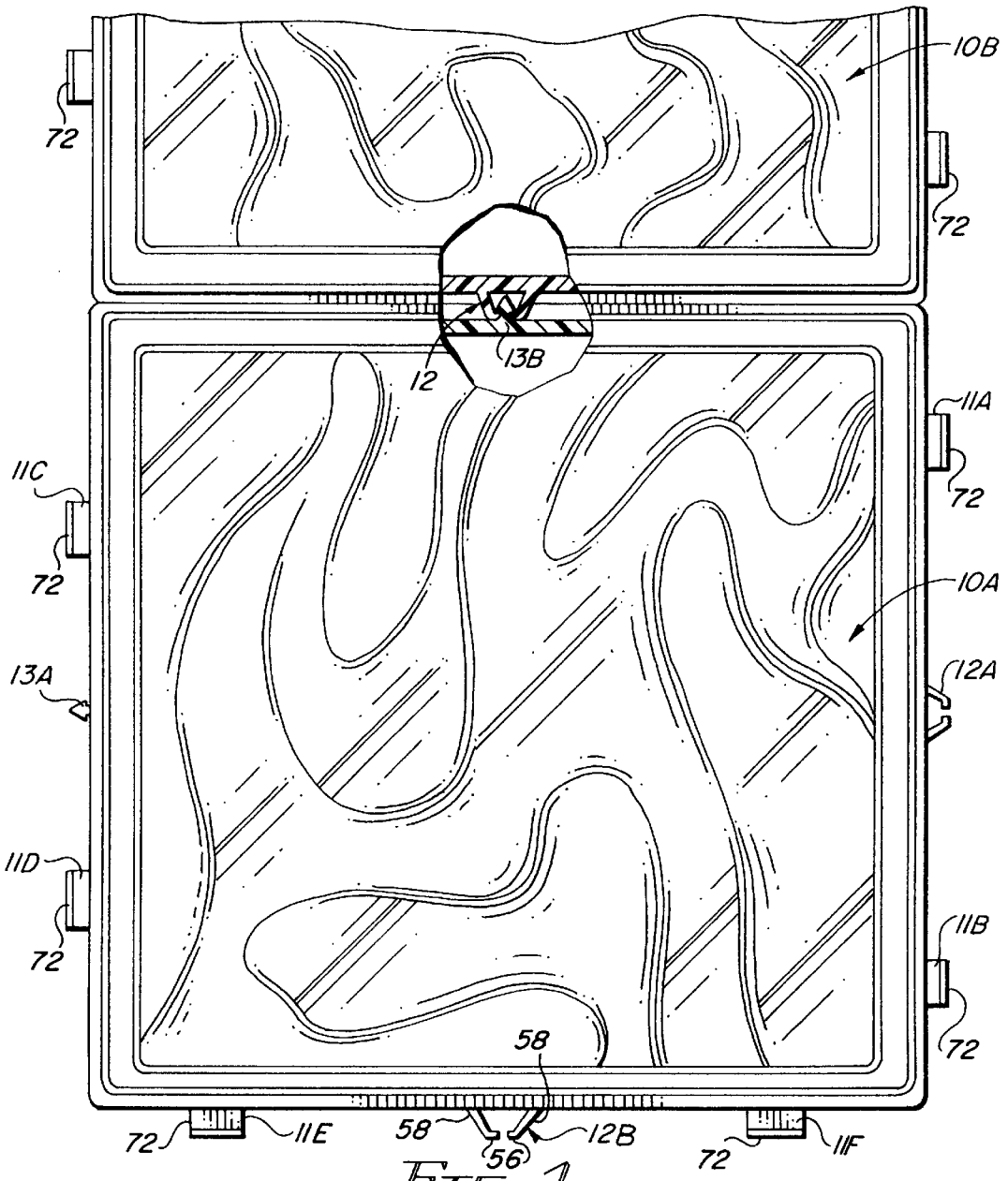
FIG. 1 illustrates a frontal view of an embodiment of the invention illustrating the tabs and locking members of the invention.

FIG. 1 illustrates a frontal view of an embodiment of the invention showing the alignment tabs and locking features of the invention. In the FIG. 1 embodiment, block 10A has been self-aligned and secured to structurally identical block 10B. Each block includes a system of spaced apart alignment tabs 11A, 11B, 11C, 11D, 11E and 11F to facilitate physical alignment of a structural system of discrete block units.

In the preferred embodiment illustrated in the drawings, individual blocks are coupled or secured to adjacent blocks by a subsystem of matching and interlocking female receptacles 12A and 12B. Male coupling elements 13A and 13B are disposed on the opposing faces of adjacent blocks.

As shown in the drawings, female receptacles 12 and male coupling elements 13 may be located within the central area of the block sidewalls to provide a block to adjacent block fastening system which facilitates preliminary block placement during initial assembly of a block system. During the process of assembling a block system from discrete blocks, individual male coupling elements 13 of a first block 10A are aligned with and inserted into or snapped into female receptacles 12 of adjacent blocks 10B. Alignment tabs 11 assist in aligning the depth or front to rear spacing of adjacent blocks to create a flat or linear surface for the block system.

Figure 2A:
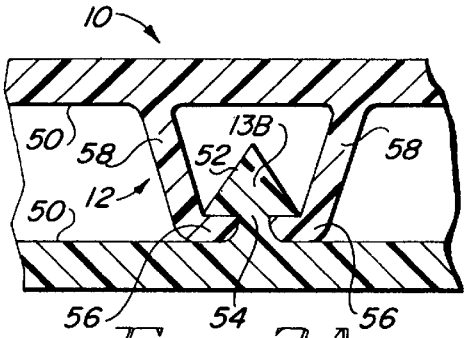
FIGS. 2A and 2B illustrate different locking mechanisms employed in different embodiments of the invention.

FIG. 2A illustrates the fastening system structure which fall including male coupling element 13B inserted into the yieldable, laterally deflectable sides of female receptacle 12 to provide a secure, interlocking connection between adjacent blocks 10.

Figure 2B:
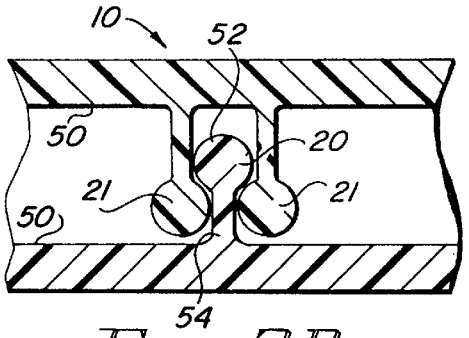
Figure 3A:
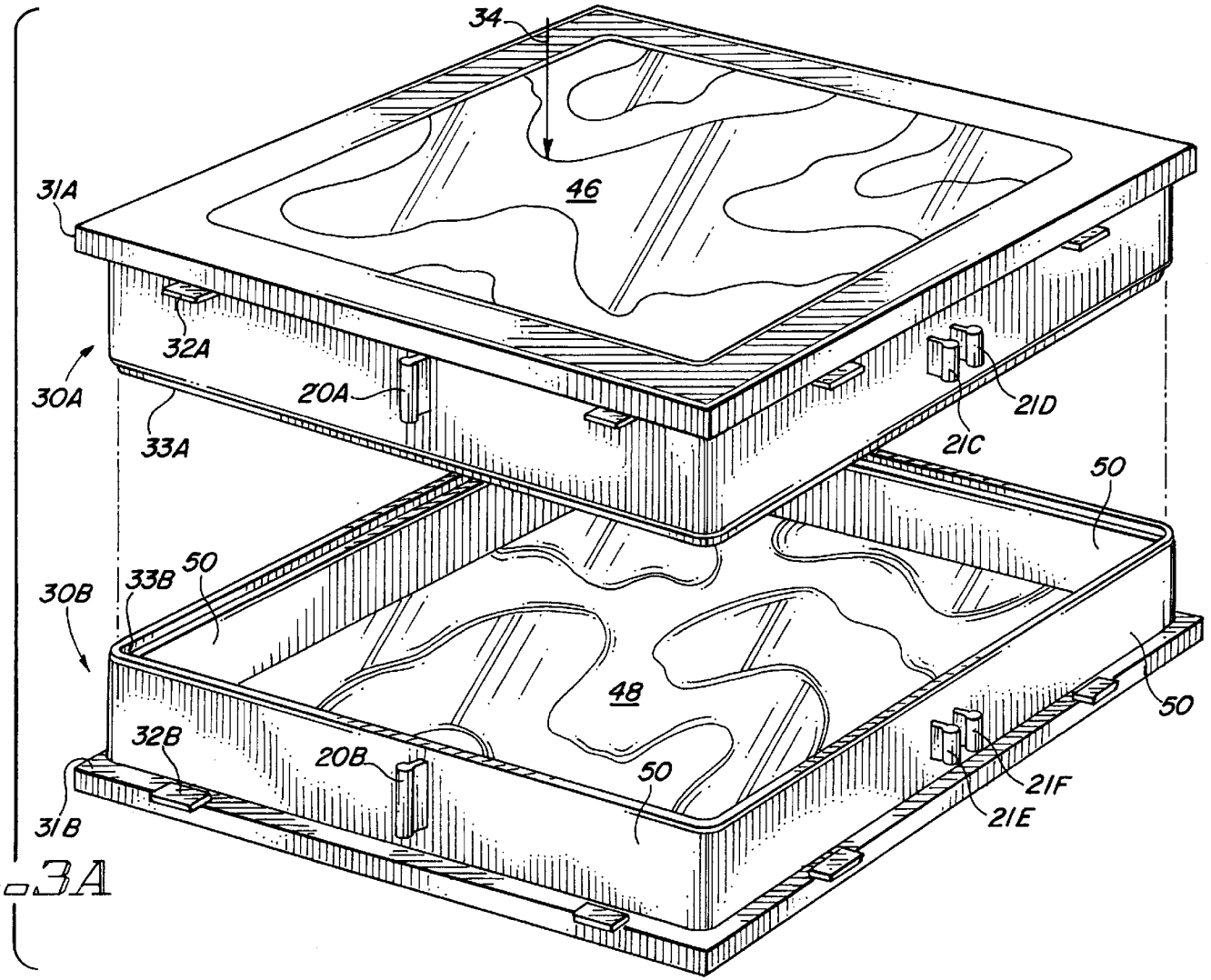
FIGS. 3A and 3B illustrate the preferred embodiment of the invention and its assembly from two discrete components.
Figure 3B:
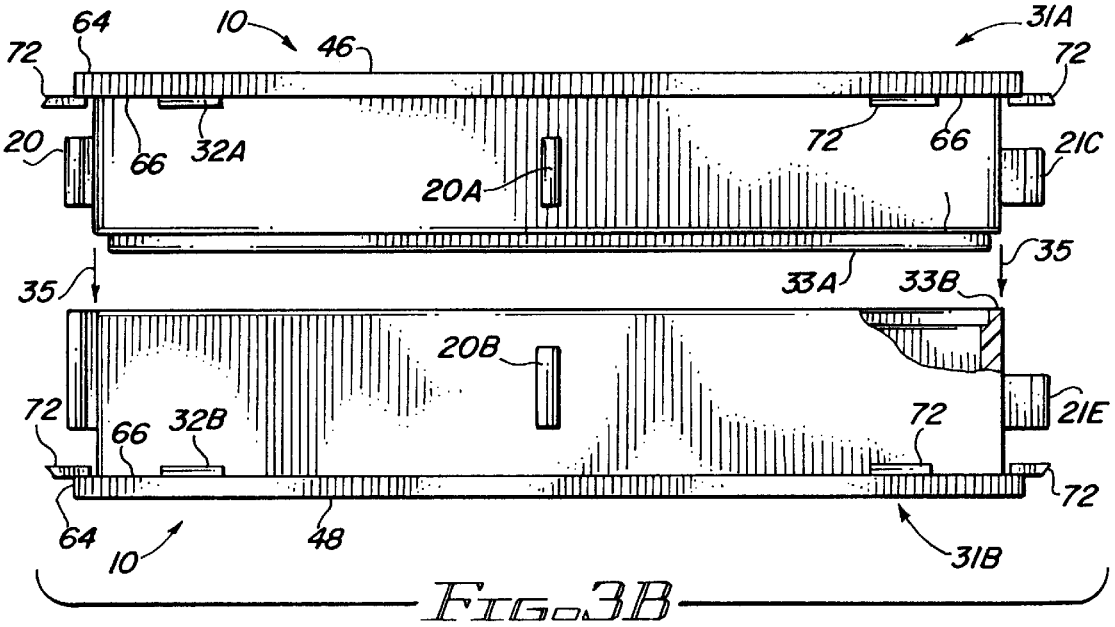

FIGS. 2B, 3A and 3B illustrate an alternative fastening system structure in which the male coupling element 20 configured as a cylindrical locking member is held at a fixed distance from the block sidewall by a pedestal element. Female receptacle 21 is configured as a pair of spaced apart cylindrical locking members oriented parallel to the male locking member where the spacing between the locking members of female receptacle 21 is configured as shown in FIG. 2B to mechanically retain the interlocking element of male coupling element 20.

When a sidewall of block 10 is pressed against a juxtaposed sidewall of a second aligned block 10, the sides of the cylindrical male interlocking member 20 engage and laterally deflect the sides of the cylindrical locking members of female receptacle 21 to receive and then lock the male coupling element into a fixed position. The laterally deflectable characteristic of the spaced apart elements of the female receptacle 21 allow previously locked together blocks to be mechanically pulled apart and unlocked to facilitate system disassembly when required.

Based on the foregoing teachings, one having ordinary skill in the art would readily recognize alternative fastening system designs equivalent in structure and function to those described above.

FIGS. 3A and 3B illustrate another preferred embodiment of the invention where each block 10 is constructed of two discrete sections consisting of upper half 30A and lower half 30B. As illustrated in the drawings, the two block sections are generally similar in configuration, but include important differences. Each section 30A and 30B is configured to provide a generally flat, translucent panel 31A and 31B for transmitting light rays 34. Upon completion of block installation only panels 31A and 31B remain exposed.

Each sidewall of each block section includes either a female receptacle or a male coupling element and a depth alignment tab. The series of depth alignment tabs positioned at spaced apart intervals around the sidewalls of each block section are configured to engage an edge of an adjoining block to align the face of one block with the faces of the adjacent blocks. The interaction of the depth alignment tabs and the block fastening system provides the necessary three dimensional alignment of the individual blocks of a structure fabricated from a plurality of blocks.

Block sections 30A and 30B are joined along the wall members by a tongue 33A which interfaces with and joins groove 33B. An adhesive or heating of the tongue 33A and groove 33B bonds block section 30A to block section 30B.

Figure 4A:
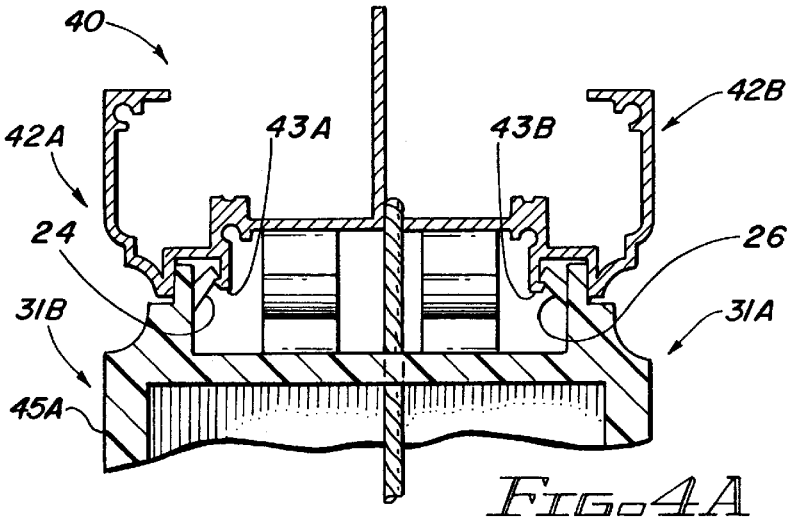
FIGS. 4A, 4B and 4C illustrate side, front and top views of an embodiment of the invention using security cables and a perimeter frame member.
Figure 4B:
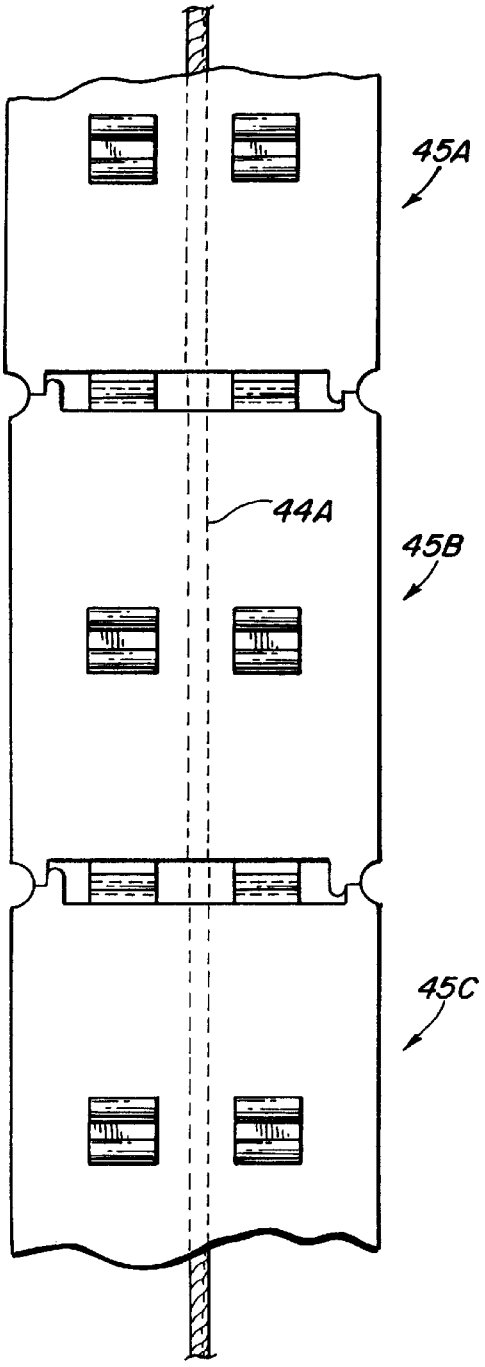
Figure 4C:
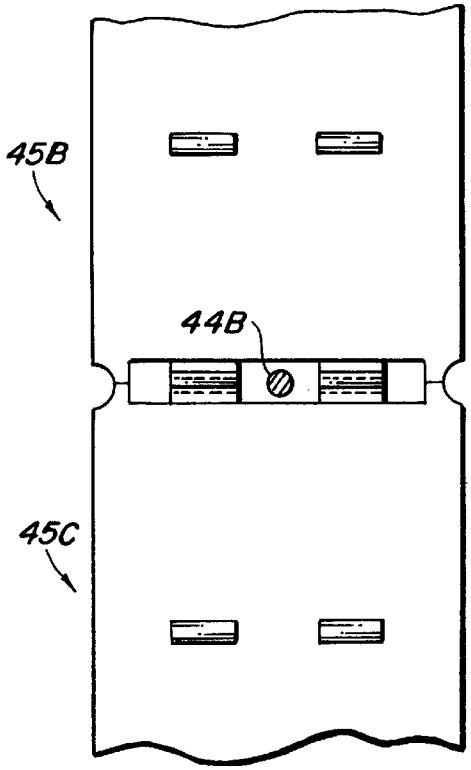

FIGS. 4A, 4B and 4C depicts the side, front and top views of an embodiment of the invention which incorporates security cables and a frame member. As shown in FIG. 4A, frame 40 surrounds the edges of the block system and may be fabricated from a variety of materials including aluminum, vinyl, plastic or wood. Frame 40 is secured to block 45A by probe locks 43A and 43B which project in a downward direction from frame 40 and engage frame alignment extensions 24 and 26. As illustrated in FIG. 4A, the engagement between probe locks 43A and 43B and frame alignment extensions 24 and 26 provides for lateral or depth alignment between frame 40 and block 45A and in addition secures those two structural elements together. In the preferred embodiment of the invention, frame 40 is constructed of aluminum to reduce the weight of the complete assembly.

In FIGS. 4B and 4C, security cables 44A and 44B are inserted through the gap between adjacent blocks and are secured to the appropriate locations of frame 40 which surrounds the outer perimeter of the block assembly. As best illustrated in FIG. 4C, cable 44B is routed through a space between the opposing ends of a male coupling element and a female receptacle. Cables 44A and 44B provide additional security to the block system by preventing breaking and removal of the blocks 45A, 45B, and 45C to gain access to a dwelling or building. In the preferred embodiment, security cables 44A and 44B are interwoven between the blocks to form the security screen.

Figure 5A:
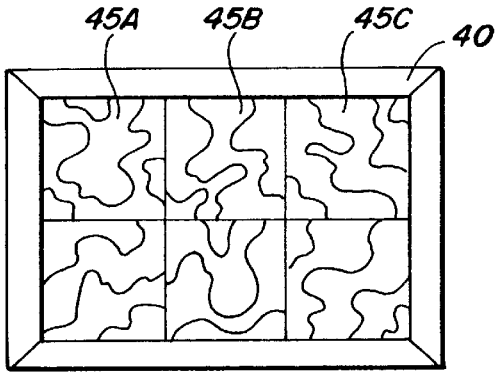
FIGS. 5A and 5B illustrate various arrangements of the perimeter framed configuration of the invention.
Figure 5B:
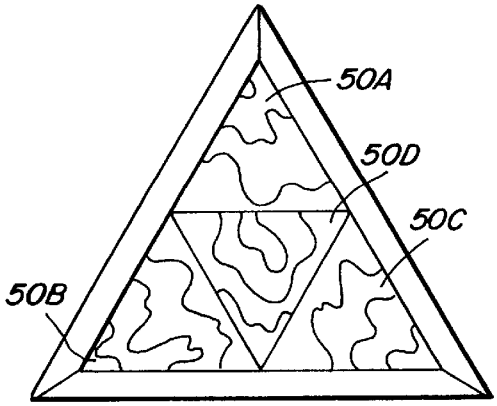

FIGS. 5A and 5B depict various arrangements for the framed application of the invention. FIG. 5A illustrates one shape in which a two by three matrix of square blocks is interlocked and encircled by frame 40. Using square blocks, such as blocks 45A, 45B and 45C, a variety of regular shapes is easily created. In FIG. 5B, triangular blocks 50A, 50B, 50C and 50D are assembled and secured by frame 40.

By using a variety of different block shapes and dimensions, a user may create an almost limitless range of aesthetically pleasing shapes which are easily incorporated into buildings. Those of ordinary skill in the art would readily recognize that the blocks of the present invention could be configured in other shapes such as hexagons, parallelograms and irregular trapezoids.

Figure 6:
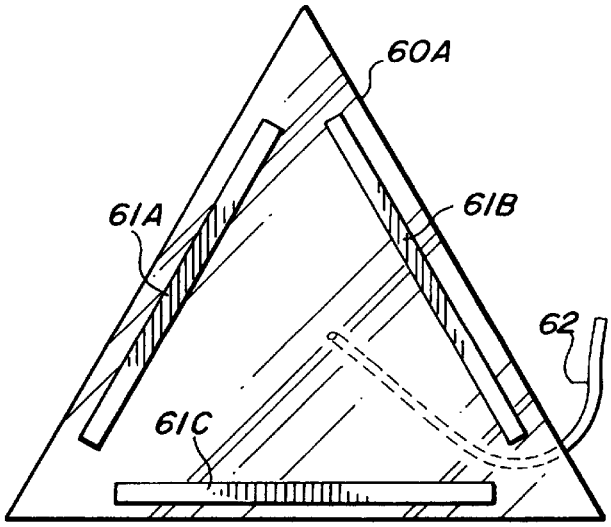
FIG. 6 represents a top view illustrating a partial wall configuration.

FIG. 6 represents a top view illustrating the blocks configured as spaced apart walls. In this embodiment of the invention, the walls which are used to separate the translucent panels do not meet. The free-standing configuration of walls 61A, 61B and 61C reduces wall height and accommodates more flexible system designs such as intertwining security cables or the routing of fiberoptic cables through the block to provide selective illumination.

Figure 7:
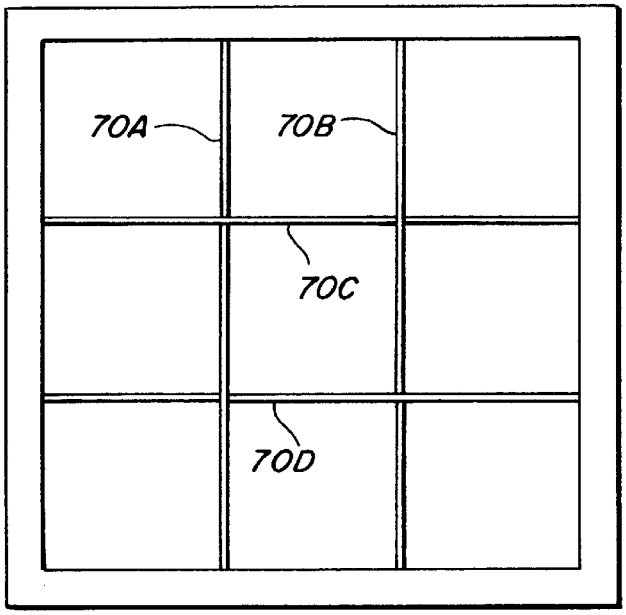
FIG. 7 illustrates a frontal view of an embodiment of the invention having interlocking cables.

FIG. 7 represents a frontal view of an embodiment of the invention illustrating interlocking cables. In this embodiment, cables 70A, 70B, 70C and 70D are secured to frame 40 and are tied to each other to provide an additional level of security.

Figure 8A:
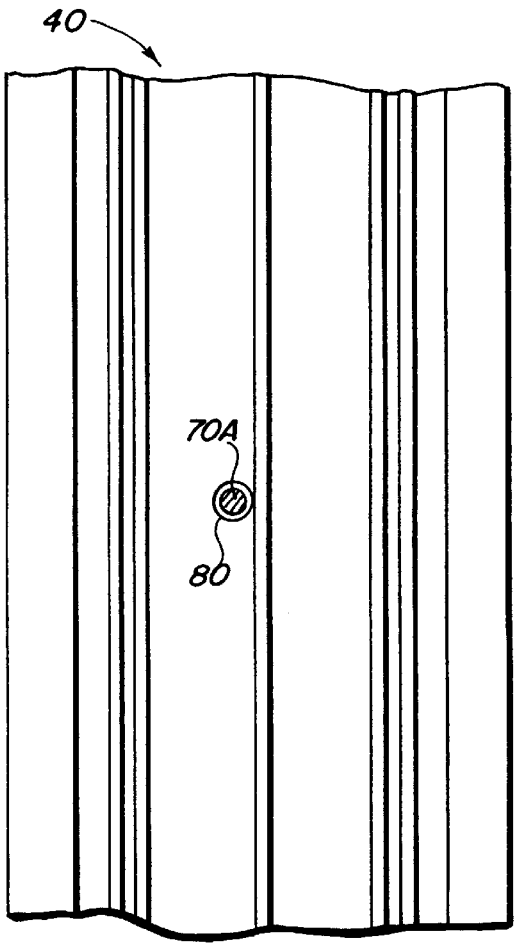
FIG. 8A represents an end view of a framing member showing the insertion of a security cable.

FIG. 8A represents an end view illustrating how a security cable is attached and interweaved with a frame member. As shown in FIG. 8, cable 70A is routed through an aperture in frame 40 and is welded or soldered to frame 40 at point 80 to enhance system strength and to prevent the cable from being removed from the frame.

Figure 8B:
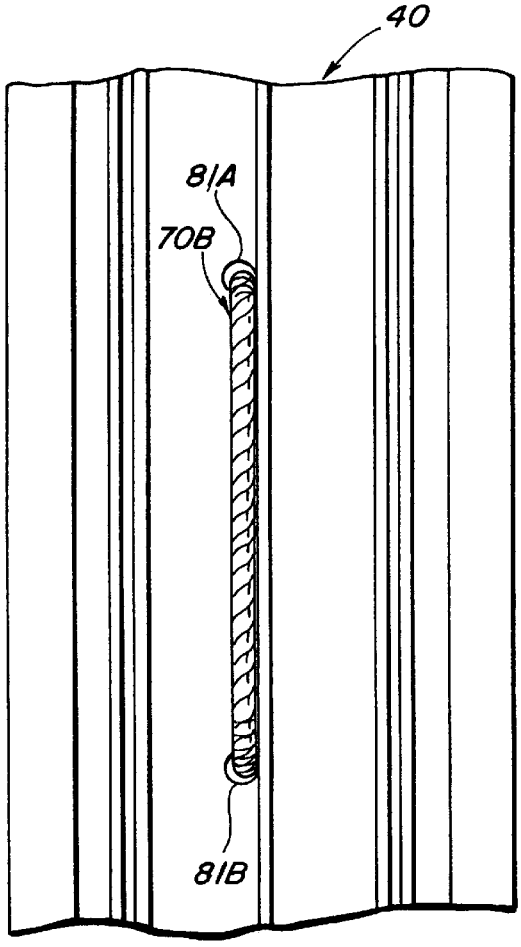
FIG. 8B illustrates an alternative embodiment of the frame of FIG. 8A adapted to permit the security cable to be interwoven through the frame.

FIG. 8B illustrates an alternative frame and cable routing configuration in which security cable 70B is woven through apertures 81A and 81B and is secured only at the cable ends.

In summary, Applicant's interlocking building block system includes a series of blocks each having a front surface 46 and a spaced apart rear surface 48. Block 10 further includes three or more linear sidewalls 50 spanning the distance between front and rear surfaces 46 and 48. As illustrated in FIGS. 5A and 5B, the blocks are shaped such that a plurality of the blocks may be arranged with juxtaposed sidewalls to form a structure having a constant surface depth dimension defined by the aligned front and rear block surfaces.

A block fastening system includes a male coupling element 13 having a configuration such as the ones illustrated in FIGS. 2A and 2B. Each male coupling element 13 includes a male interlocking element 52 with a defined maximum width. Male interlocking element 52 is supported by a pedestal element 54 having a first or lower end contacting a first sidewall 50 of a first block and a spaced apart second end which support male interlocking element 52 at a fixed distance from block sidewall 50. As illustrated in FIGS. 2A and 2B, the intersection between male interlocking element 52 and pedestal element 54 defines a reduced width capture zone located in proximity to the inboard end of male interlocking element 52 with the width less than the maximum width of the male interlocking element itself.

A female receptacle 12 is defined by first and second paired female interlocking elements and first and second spaced apart female pedestal elements 58. The first or lower end of each female pedestal element 58 contacts the adjacent sidewall of block 10 while the spaced apart second end supports the lower or inboard end of each female interlocking element 56 at a fixed distance from the block sidewall 50.

Pedestal element 54 defines a reduced width capture zone located in proximity to male interlocking element 52 with a width less than the maximum width of the male interlocking element. The spacing between the female pedestal elements 58 defines an engagement zone located in proximity to the second ends of the female pedestal elements 58 with a width sufficient to accommodate and retain male interlocking element 52. In FIG. 2A, the spacing between the first and second female interlocking elements 56 is set at a distance less the maximum width of the male interlocking element 52 to allow the female receptacle 12 to capture and retain the male coupling element 13 to thereby secure a first block to a second block.

As most clearly illustrated in FIG. 3B, each block 10 includes a perimeter edge 64 which extends outward from block sidewall 50 and is located in proximity to the front surface 46 or the rear surface 48 of block 10. The perimeter edge defines a protruding ledge having an inner ledge surface 66.

The interlocking building block of the present invention includes a depth alignment system including a depth alignment tab 72 which extends laterally outward from perimeter edge 64 and is generally oriented perpendicular to block sidewall 50. Depth alignment tab 72 is configured to engage the inner ledge surface of the perimeter edge 64 of an adjacent or second block to align the front and rear surfaces of a first block with a second block.

It will be apparent to those skilled in the art that the disclosed interlocking building block system may be modified in numerous ways and may assume many embodiments other than the preferred forms specifically set out and described above. Accordingly, it is intended by the appended claims to cover all such modifications of the invention which fall within the true spirit and scope of the invention.

It is claimed:

1. An interlockable building block comprising:

a. a block including spaced apart front and rear surfaces having a perimeter edge and at least three sidewalls spanning the distance between the front and rear surfaces, the front and rear surfaces being dimensioned such that the perimeter edge extends outward from the block sidewalls and defines a protruding ledge;

b. a block fastening system including i. a male coupling element positioned on one of the sidewalls and having a male interlocking element with a defined maximum width and a pedestal element having a first end and a spaced apart second end supporting the male interlocking element at a fixed distance from the block sidewall, the pedestal element having a width less than the maximum width of the male interlocking element to provide a reduced width capture zone located in proximity to the male interlocking element; and ii. a female receptacle positioned on a different one of the sidewalls and including first and second female interlocking elements and first and second laterally deflectable female pedestal elements laterally spaced apart along the length of the sidewall, each pedestal element having a first end coupled to the sidewall and an elevated second end, the second ends of the female pedestal elements supporting the first and second female interlocking elements at a fixed distance above the block sidewall with a lateral spacing less than the maximum width of the male interlocking element, the female receptacle configured to define a male coupling element engagement chamber below the spaced apart second ends of the female pedestal elements whereby the female receptacle laterally deflects around and captures a mateable male coupling element to provide a snap together interlocking coupling with the mateable male coupling element.

2. The interlockable building block of claim 1 further including a depth alignment tab extending beyond the perimeter edge for facilitating alignment of the front and rear surfaces of the block with an adjacent block.

3. The interlockable building block of claim 2 further including a plurality of depth alignment tabs coupled at spaced apart intervals to the perimeter edge.

4. The interlockable building block of claim 2 wherein the block includes at least one depth alignment tab extending from each block sidewall.

5. The interlockable building block of claim 1 wherein the male interlocking element is configured as cylinder.

6. The interlockable building block of claim 5 wherein the first and second female interlocking elements are each configured as a cylinder.

7. The interlockable building block of claim 1 wherein the male interlocking element is configured as a three-sided polygon having a triangular cross section.

8. The interlockable building block of claim 1 wherein the female pedestal elements are oriented perpendicular to the adjacent block sidewall.

9. The interlockable building block of claim 1 wherein the female pedestal elements are inclined toward each other.

10. The interlockable building block of claim 1 wherein the block perimeter edge includes a frame alignment extension for contacting and engaging a frame and for aligning the block front and rear surfaces with the frame.

11. An interlocking building block assembly comprising:

a. a first block including spaced apart front and rear surfaces having a perimeter edge and at least three sidewalls spanning the distance between the front and rear surfaces, the front and rear surfaces being dimensioned such that the perimeter edge extends outward from the block sidewalls and defines a protruding ledge further including a block fastening system including a male coupling element positioned on one of the sidewalls and having a male interlocking element with a defined maximum width and a pedestal element having a first end and a spaced apart second end supporting the male interlocking element at a fixed distance from the block sidewall, the pedestal element having a width less than the maximum width of the male interlocking element to provide a reduced width capture zone located in proximity to the male interlocking element;

b. a second block including spaced apart front and rear surfaces having a perimeter edge and at least three sidewalls spanning the distance between the front and rear surfaces, the front and rear surfaces being dimensioned such that the perimeter edge extends outward from the block sidewalls and defines a protruding ledge further including a block fastening system including a female receptacle positioned on a different one of the sidewalls and including first and second female interlocking elements and first and second laterally deflectable female pedestal elements laterally spaced apart along the length of the sidewall, each pedestal element having a first end coupled to the sidewall and an elevated second end, the second ends of the female pedestal elements supporting the first and second female interlocking elements at a fixed distance above the block sidewall with a lateral spacing less than the maximum width of the male interlocking element, the female receptacle configured to define a male coupling element engagement chamber below the spaced apart second ends of the female pedestal elements whereby the female receptacle on the second block laterally deflects around and captures the male coupling element on the first block to provide a snap together interlocking coupling between the first and second blocks.

12. The interlockable building block assembly of claim 11 wherein the first and second blocks each include a depth alignment system consisting of a plurality of spaced apart depth alignment tabs extending laterally outward from the perimeter edge and oriented perpendicular to the block sidewalls to assist in aligning the front and rear surfaces of the first and second blocks.

13. The interlockable building block of claim 12 wherein the depth alignment system includes at least one depth alignment tab extending from each block sidewall.

14. The interlockable building block assembly of claim 11 wherein the male interlocking element is configured as a cylinder.

15. The interlockable building block assembly of claim 14 wherein the first and second female interlocking elements are each configured as a cylinder.

16. The interlockable building block assembly of claims 11 or 12 further including a frame for engaging and retaining the first and second blocks in a defined structural configuration wherein each block includes a midsection and wherein the perimeter edge of each block includes a frame alignment extension for contacting a defined surface of the frame and for aligning the block front and rear surfaces with the frame.

17. The interlockable building block assembly of claim 11 wherein the adjacent sidewalls of the first and second blocks intersect to define a block edge and wherein the spacing between the male coupling element and the nearest edge of the first block is substantially equal to the spacing between the female receptacle and the nearest edge of the second block.

18. The interlockable building block assembly of claim 11 wherein each block sidewall includes a midpoint and wherein the male coupling element of the first block is located at the sidewall midpoint and the mateable female receptacle of the second block is located at the sidewall midpoint.

19. The interlockable building block assembly of claim 11 wherein the capture zone of the male coupling element is inserted within the engagement chamber of the female receptacle when the first block is mated to the second block.

* * * * *